US005642150A

United States Patent [19]

Takahashi

[11] Patent Number: 5,642,150

[45] Date of Patent: Jun. 24, 1997

[54] LIGHT DEFLECTOR

[75] Inventor: Masahiro Takahashi, Ebina, Japan

[73] Assignee: Fuji Xerox Co., Ltd., Tokyo, Japan

[21] Appl. No.: 276,458

[22] Filed: Jul. 18, 1994

[30] Foreign Application Priority Data

Aug. 5, 1993 [JP] Japan ..... 5-194517

[51] Int. Cl.[6] ..... B41J 7/47

[52] U.S. Cl. ..... 347/257; 347/242

[58] Field of Search ..... 347/257, 242

[56] References Cited

U.S. PATENT DOCUMENTS 4,443,043 4/1984 Yamaguchi ..... 359/218

FOREIGN PATENT DOCUMENTS 59-23324 2/1984 Japan .

3-77909 4/1991 Japan .

3-194513 8/1991 Japan .

3-81915 8/1991 Japan .

4-42118 2/1992 Japan .

*Primary Examiner*—Mark J. Reinhart

*Attorney, Agent, or Firm*—Oliff & Berridge

[57] ABSTRACT

A light deflector wherein a polygon mirror rotating at a predetermined speed is used to deflect a beam of light irradiated from a laser light source to scan a photosensitive member or an original image with the deflected beam of light is improved in that the polygon mirror can be fixed firmly to the rotary member without disturbing smooth rotation of the polygon mirror. A screw member on which a male thread is formed is fitted on an outer periphery of the rotary member, and the polygon mirror is pressed against and secured to an annular mirror flange provided on the rotary member by a mirror cap screwed on the screw member.

16 Claims, 10 Drawing Sheets

LIGHT DEFLECTOR

BACKGROUND OF THE INVENTION

1. Field of the Invention

This invention relates to a light deflector for scanning an original image or a photosensitive member with a beam of light irradiated from a laser light source, for example, in an image reading system of a digital copying machine, a facsimile or a like apparatus or an image writing system of a laser beam printer or a like apparatus.

2. Description of the Related Art

Conventionally, in a reading system for an original image, a method of irradiating a beam of light upon an original image to scan the original image to obtain density information for individual picture elements from reflected light is known, and in a writing system for a recording image, another method of irradiating a beam of light, which is modulated in accordance with picture information, upon a photosensitive member to scan the photosensitive member to form an electrostatic latent image is known. In both systems, an optical scanning system which employs a light deflector including a polygon mirror is known as a system for scanning an original image or a photosensitive member with a beam of light irradiated from a laser light source.

FIG. 8 is a schematic view showing an image writing system which employs such scanning system. Referring to FIG. 8, the image writing system shown includes a laser light source 100, a collimator lens 101, a light deflector 102 including a polygon mirror 102*a*, an f-θ lens 103, and a photosensitive drum 104. A beam of light irradiated from the laser light source 100 is reflected by a reflecting mirror face of the polygon mirror 102*a* and introduced to the photosensitive drum 104. Thereupon, the beam of light is deflected by the polygon mirror 102*a* as the polygon mirror 102*a* rotates in the direction indicated by an arrow mark A so that it scans the photosensitive drum 104 along the direction indicated by an arrow mark B. Meanwhile, the photosensitive drum 104 rotates in the direction indicated by an arrow mark C, and a two-dimensional electrostatic latent image is formed on the photosensitive drum 104.

Conventionally, a light deflector which is used for such an application as described above is disclosed in Japanese Patent Laid-Open Application No. Sho 59-23324 and Japanese Utility Model Laid-Open Application No. Hei 3-81915. In particular, the light deflector is constructed such that a rotary member is supported for rotation on a fixed shaft mounted uprightly on a housing while a polygon mirror is secured to a mirror flange formed on the rotary member and is rotated together with the rotary member by a motor section incorporated in the housing. Further, in the conventional light deflector, the polygon mirror is pressed against the mirror flange by a mirror cap screwed on an outer periphery of the rotary member and is thus held and fixed between and by the mirror cap and the mirror flange.

In the conventional light deflector, however, since the mirror cap is screwed directly on the rotary member, if the mirror cap is fastened tightly to the rotary member in order to fix the polygon mirror with security, then the rotary member is compressed toward the inner side, resulting in the following problem. In particular, in light deflectors in recent years, in order to satisfy the demands for an increase of the speed of rotation and a decrease of vibrations of a polygon mirror and so forth, a dynamic pressure pneumatic bearing is employed to support the rotary member in a contactless condition on the fixed shaft. In this instance, since the gap (hereinafter referred to as bearing clearance) between the fixed shaft and the rotary member is only approximately 3 mm, if the rotary member is compressed toward the inner side, then the fixed shaft and the rotary member are brought into contact with each other, and consequently, rotation of the polygon mirror is disturbed. Or, even if the fixed shaft and the rotary member are not contacted with each other, if the bearing clearance varies, then rotation of the rotary member becomes non-uniform, resulting in non-uniform rotation of the polygon mirror.

SUMMARY OF THE INVENTION

It is an object of the present invention to provide a light deflector wherein a polygon mirror can be fixed firmly on a rotary member without disturbing smooth rotation of the polygon mirror.

In order to attain the object described above, according to the present invention, there is provided a light deflector, which comprises a polygon mirror having a plurality of reflection mirror faces formed on an outer periphery thereof, a rotary member rotating at a predetermined speed and including an annular flange to which the polygon mirror is secured, a screw member having a male thread formed thereon and fitted on an outer periphery of the rotary member, and a mirror cap screwed with the screw member to press the polygon mirror against the mirror flange to secure the polygon mirror to the rotary member.

In the light deflector, the rotary member may have any configuration only if it rotates smoothly holding the polygon mirror thereon, and for example, it may be a sleeve which rotates around the fixed shaft by way of a bearing or may be a rotary shaft which rotates at the center of a fixed sleeve by way of a bearing.

Meanwhile, the mirror flange may be formed integrally with the rotary member or may be formed as a separate member from the rotary member and fitted on the outer periphery of the rotary member only if it is provided projectingly on the outer periphery of the rotary member and supports the polygon mirror thereon.

Further, in the construction described above, when the mirror cap is fastened to the screw member, a compressing force acts in a radial direction of the screw member. In order to prevent the compressing force to be transmitted to the rotary member, preferably the screw member has a Young's modulus lower than that of the rotary member.

By the way, when the rotary member rotates at a high speed, it is supposed that a centrifugal force acts upon the polygon mirror and that the temperatures of the polygon mirror, the screw member, the mirror cap and the mirror flange may be raised high due to heat generation by a motor section for driving the rotary member or by shearing frictional heat of air. Accordingly, in order to prevent such a situation as much as possible that the polygon mirror held between the mirror cap and the mirror flange is deformed by the centrifugal force or thermal expansion to cause distortion of the reflection mirror faces of the polygon mirror for a beam of light, preferably the Young's modulus and/or the coefficient of thermal expansion of the screw member are substantially equal to that or those of the polygon mirror. In this instance, preferably the Young's modulus and/or the coefficient of thermal expansion of the screw member are substantially equal to that or those of the mirror cap. Further preferably, the Young's modulus and/or the coefficient of thermal expansion of the mirror flange are substantially equal to those of the mirror cap and the screw member.

Preferably, the coefficients of the mirror flange and/or the mirror cap are substantially equal to that of the polygon mirror.

Preferably, the Young's modulus of the mirror flange and/or the mirror cap are substantially equal to that of the polygon mirror.

Preferably, the mirror flange has an outer profile substantially same as or similar to that of the polygon mirror.

Preferably, the light deflector further comprises a pressure adjustment member disposed between the polygon mirror and the mirror cap and having a Young's modulus substantially equal to or lower than that of the polygon mirror. In this instance, preferably the pressure adjustment member has a coefficient of linear expansion substantially equal to that of the polygon mirror. The pressure adjustment member may have a plurality of holes or a plurality of radial slits formed therein or may have a hollow structure.

With the light deflector, since the screw member on which the male thread is formed is fitted on the outer periphery of the rotary member and the mirror cap which cooperates with the mirror flange to hold and secure the polygon mirror therebetween is screwed on the screw member, the compressing force by fastening of the mirror cap does not act directly upon the rotary member. Consequently, smooth rotational motion of the rotary member is assured while preventing non-uniform rotation of the rotary member, and the polygon mirror can be secured firmly on the rotary member without disturbing smooth rotation of the polygon mirror.

The above and other objects, features and advantages of the present invention will become apparent from the following description and the appended claims, taken in conjunction with the accompanying drawings in which like parts or elements are denoted by like reference characters.

DETAILED DESCRIPTION OF THE PREFERRED EMBODIMENTS

Figure 1:
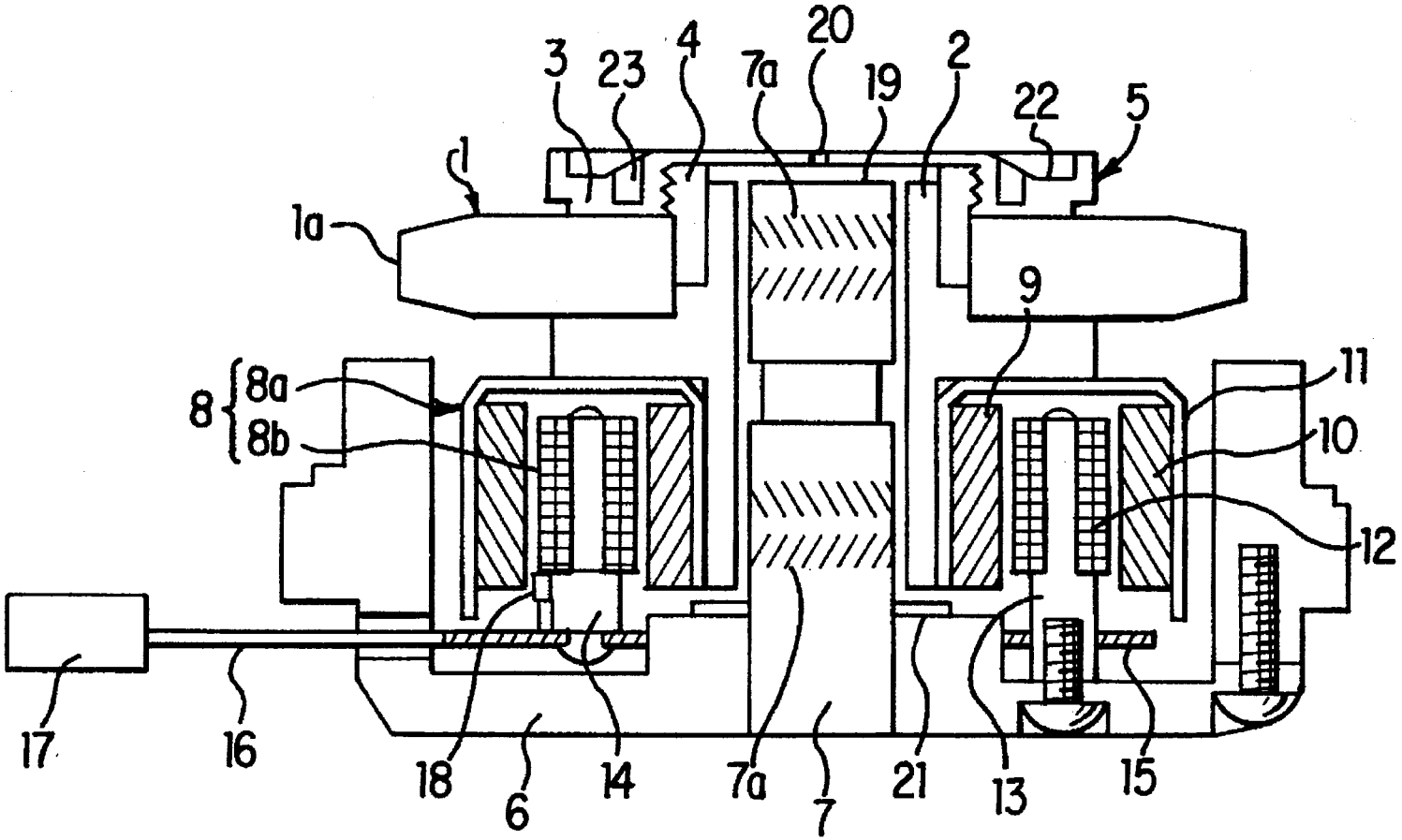
FIG. 1 is a schematic axial sectional view of a light deflector showing a first preferred embodiment of the present invention.

Referring first to FIG. 1, there is shown a light deflector according to a first preferred embodiment of the present invention, The light deflector shown includes a polygon mirror 1 having eight reflection mirror faces la on an outer periphery thereof, a rotary sleeve 2 for holding the polygon mirror 1 for integral rotation thereon, a mirror flange 3 provided projectingly on the rotary sleeve 2, a screw member 4 fitted on an outer periphery of the rotary sleeve 2, and a mirror cap 5 for being screwed on the screw member 4 to cooperate with the mirror flange 3 to hold the polygon mirror 1 therebetween.

The rotary sleeve 2 is loosely fitted on a fixed shaft 7 mounted uprightly on a housing 6 with a predetermined gap (hereinafter referred to as bearing gap) left therebetween. The rotary sleeve 2 and the fixed shaft 7 thus construct a dynamic pressure pneumatic bearing for a radial direction. In particular, a plurality of dynamic pressure generating grooves **7*a* are formed in a herringbone pattern an an outer periphery of the fixed shaft 7, and when the rotary sleeve 2 rotates, a pneumatic dynamic pressure is generated in the bearing gap so that the rotary sleeve 2 is supported by an air lubrication film of a high pressure and rotates in a contactless condition around the fixed shaft 7. It is to be noted that, while the dynamic pressure generating grooves 7*a* in the present embodiment are formed on the outer periphery of the fixed shaft 7, such dynamic pressure generation grooves may alternatively be formed on an inner periphery of the rotary sleeve 2**.

The light deflect shown in FIG. 1 further includes a motor 8 for driving the rotary sleeve 2 to rotate. The motor 8 includes a rotor section **8*a* secured to an outer periphery of the rotary sleeve 2, and a stator section 8*b* secured to the housing 6**.

Figure 2:
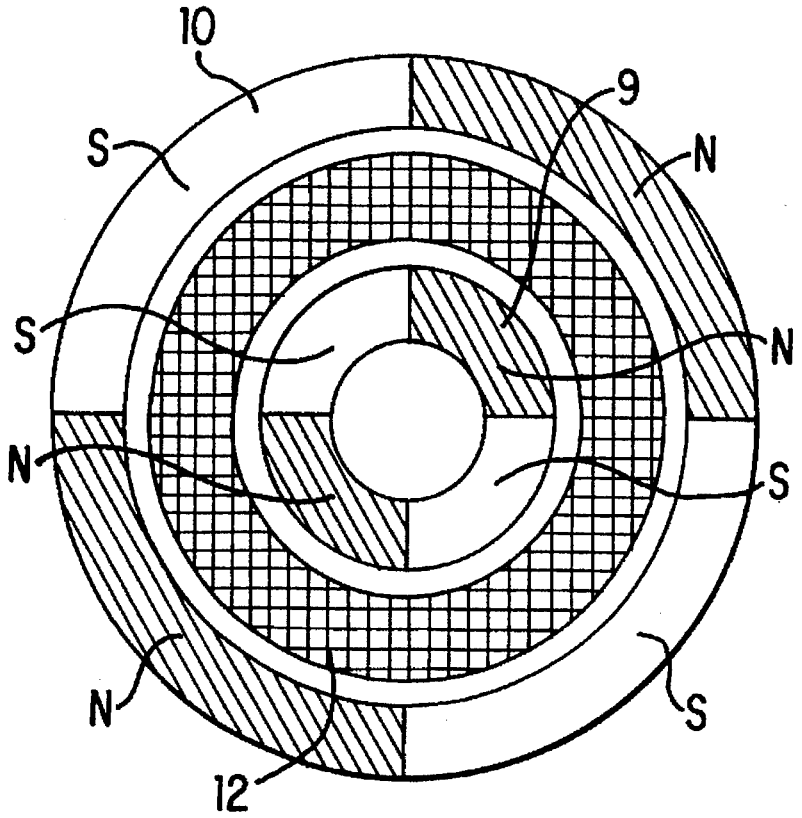
FIG. 2 is a transverse sectional view showing a motor of the light deflector shown in FIG. 1.

The rotor section **8*a* includes an annular inner magnet 9 and an annular outer magnet 10, which are securely mounted in a magnet yoke 11. Referring particularly to FIG. 2, the magnets 10 and 9 are disposed on an outer periphery and an inner periphery, respectively, of a stator core 12, which will be hereinafter described, and are each magnetized with four poles disposed at equal distances along a circumference. Each opposing ones of the magnetic poles of the magnets 9 and 10 across the stator core 12** have a same polarity.

A magnetic attracting force always acts between the inner magnet 9 and the stator core 12 and between the outer magnet 10 and the stator core 12, and the magnets 9 and 10 and the stator core 12 cooperate with one another to construct a magnetic thrust bearing. In particular, if the mirror flange 3 is displaced in a thrust direction (axial direction of the fixed shaft) from a predetermined position, then the rotary sleeve 2 is drawn back by the magnetic attracting forces described above to the predetermined position at which the magnets 9 and 10 and the stator core 12 oppose regularly to each other, and the rotary sleeve 2 is always held at the predetermined position in the thrust direction.

Meanwhile, the stator section **8*b* includes the stator core 12 supported on a stud 13 mounted uprightly on the housing 6, and electromagnetic coils (not shown) are wound each in a troidal shape around the stator core 12. A plurality of circuit board 15 are secured to the stator core 12 each by way of a stud 14, and the electromagnetic coils are connected to wiring lines printed on the circuit board 15. The circuit board 15 is connected to a control circuit section not shown by way of a wire 16 and a connector 17**.

The directions of electric currents to be supplied to the electromagnetic coils are determined in accordance with a detection signal of a magnetic detection sensor 18 mounted uprightly on the circuit board 15. In particular, the magnetic detection sensor 18 detects leakage fluxes of the inner magnet 9 and the outer magnet 10 of the rotor section 8*a* and transmits the detection signal to the control circuit section mentioned above. The control circuit section thus determines from the detection signal whether the magnetic poles of the inner magnet 9 and the outer magnet 10 which have passed the magnetic detection sensor 18 are the N poles or the S poles, and determines the directions of electric currents to be supplied to the electromagnetic coils wound at several locations of the stator core 12. As a result, a force always acts in a direction to continue the rotation of the rotary sleeve 2 between the electromagnetic coils and the magnets 9 and 10 so that a predetermined speed of rotation is provided to the rotary sleeve 2.

Subsequently, mounting of the polygon mirror 1 onto the rotary sleeve 2 will be described.

The polygon mirror 1 has a center hole formed therein which has an inner diameter a little greater than the outer diameter of the screw member 4, and the polygon mirror 1 is carried on the mirror flange 3 with the screw member 4 fitted in the center hole. The mirror cap 5 screwed on the screw member 4 contacts with the top of the polygon mirror 1 to press the polygon mirror 1 against the mirror flange 3.

Figure 3:
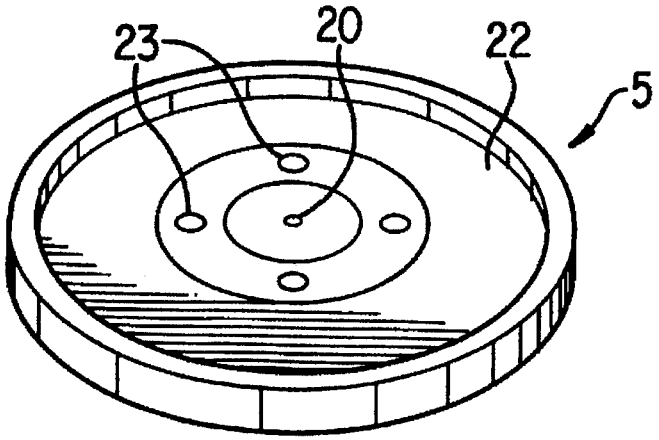
FIG. 3 is a perspective view as viewed from above showing a mirror cap of the light deflector shown in FIG. 1.
Figure 4:
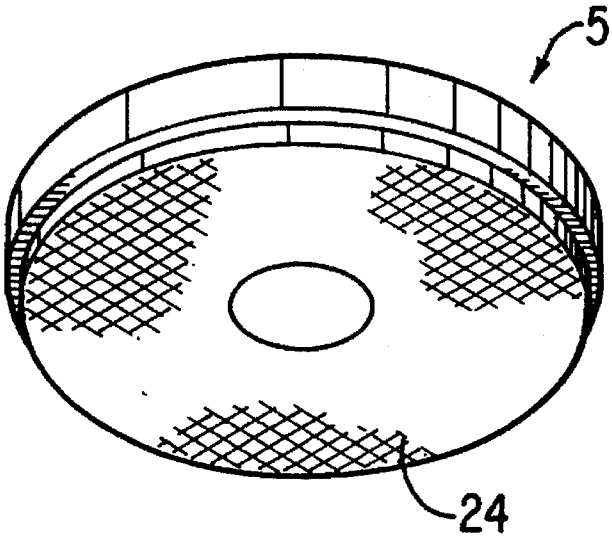
FIG. 4 is a perspective view as viewed from below showing the mirror cap shown in FIG. 3.

Referring now to FIG. 3, an annular balance adjustment groove 22 is formed at the top of the mirror cap 5, and a ballast or ballasts are suitably secured to the balance adjustment groove 22 to assure well balanced rotation of the polygon mirror 1. Further, a suitable number of connection holes 23 adapted to receive a jig for exclusive use (not shown) are formed at the top of the mirror cap 5 so that the mirror cap 5 may be tightened into the screw member 4 by means of the jig fitted in the connection holes 23. Meanwhile, the bottom face of the mirror cap 5 which contacts with the polygon mirror 1 is formed as a flattened face, and from the point of view of preventing loosening of the mirror cap 5 tightened to the screw member 4, preferably the bottom face of the mirror cap 5 has knurled grooves 24 formed thereon as shown in FIG. 4.

Figure 5:
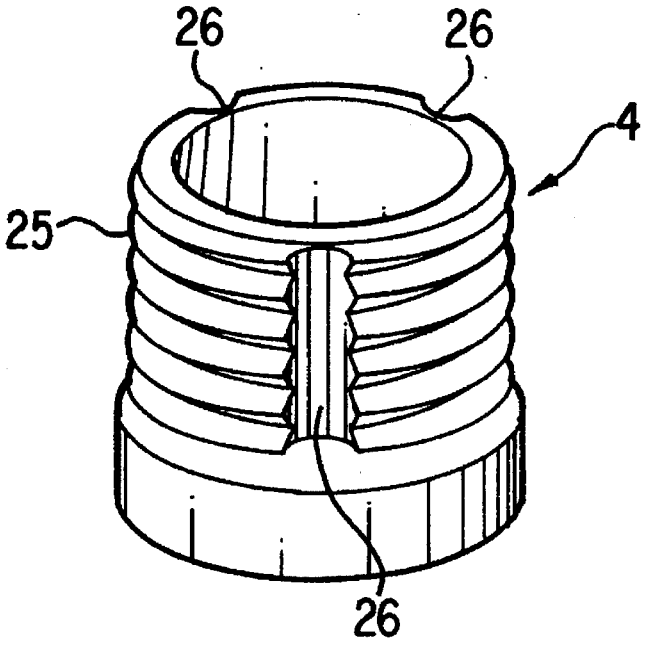
FIG. 5 is a perspective view showing a screw member of the light deflector shown in FIG. 1.

The screw member 4 in which the mirror cap 5 is screwed is securely mounted on the outer periphery of the rotary sleeve 2 by force fitting or adhesion. Referring to FIG. 5, a male thread 25 with which the mirror cap 5 is screwed is formed on the outer periphery of the screw member 4, and several recessed grooves 26 for filling a bonding agent therein are formed on the male thread 25. Therefore, if the mirror cap is screwed with a bonding agent filled in the recessed grooves 26, then loosening of the mirror cap 5 tightened to the screw member 4 is prevented.

Referring back to FIG. 1, in a condition wherein the mirror cap 5 is screwed on the screw member 4, an air room 19 is formed between the top end of the fixed shaft 7 and the mirror cap 5 to prevent damping in the thrust direction. The air room 19 is communicated with the external air by way of a fine hole 20 in order to stabilize the damping effect. A damper 21 is disposed on the housing 6 below the rotary sleeve 2 so as to prevent possible contact between the rotary sleeve 2 and the housing 6 when the rotary sleeve 2 is in a stopping condition or when an external force acts upon the rotary sleeve 2 during rotation.

Further, in the present embodiment, the rotary sleeve 2 is formed from, for example, a ceramics material. Meanwhile, the polygon mirror 1 is formed from aluminum, and the screw member 4 is formed from aluminum which has a Young's modulus lower than that of the rotary sleeve 2 but substantially equal to that of the polygon mirror 1 and has a coefficient of thermal expansion substantially equal to that of the polygon mirror 1.

In the present embodiment, the polygon mirror 1 is formed from aluminum and has a coefficient of thermal expansion of $23\times10^{-6}$ /deg and a Young's modulus of 7,500 kgf/mm$^2$. Also the mirror flange 3 and the mirror cap 5 are formed from aluminum. In other words, the coefficients of thermal expansion and the Young's moduli of the mirror flange 3 and the mirror cap 5 are set substantially equal to those of the polygon mirror 1. Accordingly, even if thermal energy generated from the motor 8 flows into the polygon mirror 1, the mirror flange 3 and the mirror cap 5 to raise the temperatures of them high, since the coefficient of thermal expansion of the polygon mirror 1 in a radial direction is substantially equal to those of the mirror flange 3 and the mirror cap 5 between which the polygon mirror 1 is held, compressive stress or tensile stress is not generated in the polygon mirror 1, and consequently, distortion of the reflection mirror faces 1*a* by deformation of the polygon mirror 1 can be suppressed. Further, since the Young's moduli of the mirror flange 3 and the mirror cap 5 are set higher than that of the polygon mirror 1, even if the polygon mirror 1 tends to be deformed in a radial direction by a centrifugal force, the mirror flange 3 and the mirror cap 5 between which the polygon mirror 1 is held suppresses such possible deformation. Consequently, also in this regard, distortion of the reflection mirror faces 1*a* can be suppressed.

In the light deflector of the present embodiment having the construction described above, since the polygon mirror 1 is held and fixed between and by the the mirror flange 3 and the mirror cap 5 by fastening the mirror cap 5 to the screw member 4, the polygon mirror 1 is deformed substantially uniformly without being locally deformed by a centrifugal force or heat generated by rotation of the polygon mirror 1. As a result, distortion of the reflection mirror faces 1*a* of the polygon mirror 1 is suppressed, and otherwise possible deterioration of the accuracy in reflection direction of a beam of light incident to the reflection mirror faces 1*a*, that is, deterioration of the accuracy of the angle by which a beam of light scans a photosensitive member or an original, can be prevented. Further, it has been confirmed by the inventors that, if the screw member 4 and the mirror cap 5 are tightened to each other with the fastening torque of 1 kgcm to 10 kgcm, then the distortion of the reflection mirror faces 1*a* can be suppressed to such a degree at which it has no influence on scanning of a photosensitive member or the like.

Further, since the mirror cap 5 is screwed on the screw member 4 fitted on the outer periphery of the rotary sleeve 2, the compressing force in a radial direction generated by fastening of the mirror cap 5 is damped by the screw member 4 so that the compressing force can be prevented from acting upon the rotary sleeve 2 as much as possible. In addition, in the present embodiment, since the Young's modulus of the mirror cap 5 is lower than that of the rotary sleeve 2, the compressing force mentioned above is absorbed effectively by the screw member 4.

Accordingly, even if the mirror cap 5 is tightened firmly, the rotary sleeve 2 and the fixed shaft 7 do not contact with each other, and such a situation that the bearing gap between the fixed shaft 7 and the rotary sleeve 2 varies to make rotation of the rotary sleeve 2 unstable does not occur. Consequently, the polygon mirror 1 can rotate stably.

Further, in the present embodiment, since the Young's modulus and the coefficient of thermal expansion of the screw member 4 are substantially equal to those of the polygon mirror 1, even if a centrifugal force or heat acts upon the polygon mirror 1 and the screw member 4, they exhibit substantially equal amounts of deformation to each other, and consequently, the reflection mirror faces 1*a* of the polygon mirror 1 can be prevented from being distorted by an influence of a centrifugal force or heat.

Further, if, in the present embodiment, the mirror cap 5 which presses the polygon mirror 1 against the mirror flange 3 has a Young's modulus and a coefficient of thermal expansion substantially equal to those of the polygon mirror 1 and the screw member 4, then the mirror cap 5 and the mirror flange 3 do not compress the polygon mirror 1 excessively by an influence of a centrifugal force or heat, and consequently, otherwise possible distortion of the reflection mirror faces 1*a* can be prevented further effectively.

Figure 6:
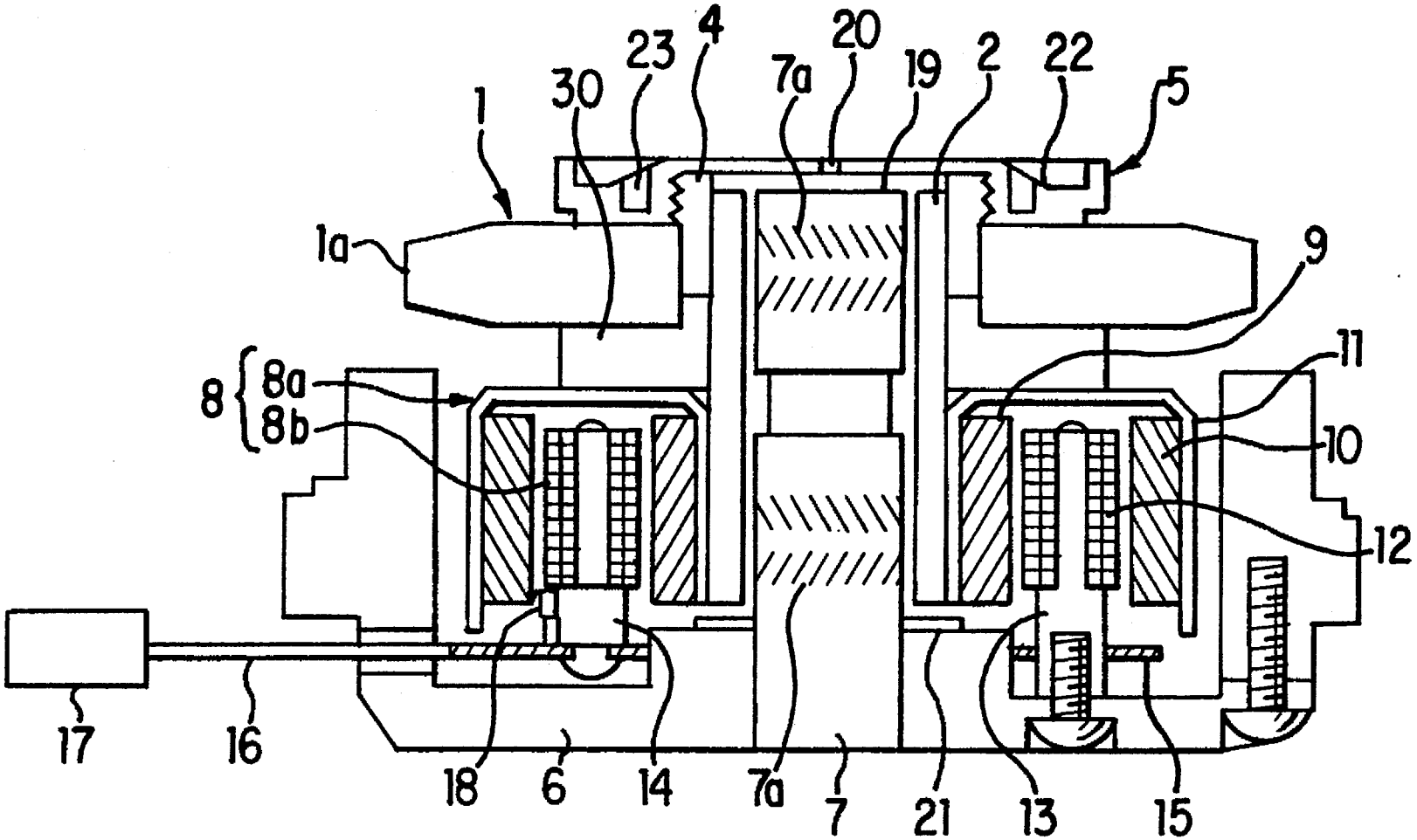
FIG. 6 is a schematic axial sectional view of another light deflector showing a second preferred embodiment of the present invention.

Referring now to FIG. 6, there is shown a light deflector according to a second preferred embodiment of the present invention. The present light deflector is a modification to and includes several common components to those of the light deflector of the first embodiment described above, and overlapping description of the common components will be omitted herein to avoid redundancy. This also applies to the other embodiments which will be hereinafter described.

The present light deflector is different from the light deflector of the first embodiment in that a mirror flange 30 on which the polygon mirror 1 is supported is formed as a separate member from the rotary sleeve 2 and force fitted in the rotary sleeve 2.

The mirror flange 30 has a Young's modulus and a coefficient of thermal expansion substantially equal to those of the polygon mirror 1, the screw member 4 and the mirror cap 5 so that the mirror cap 5 and the mirror flange 30 may not compress the polygon mirror 1 excessively by an influence of a centrifugal force or heat. Consequently, otherwise possible distortion of the reflection mirror faces 1*a* can be prevented further effectively.

Figure 7:
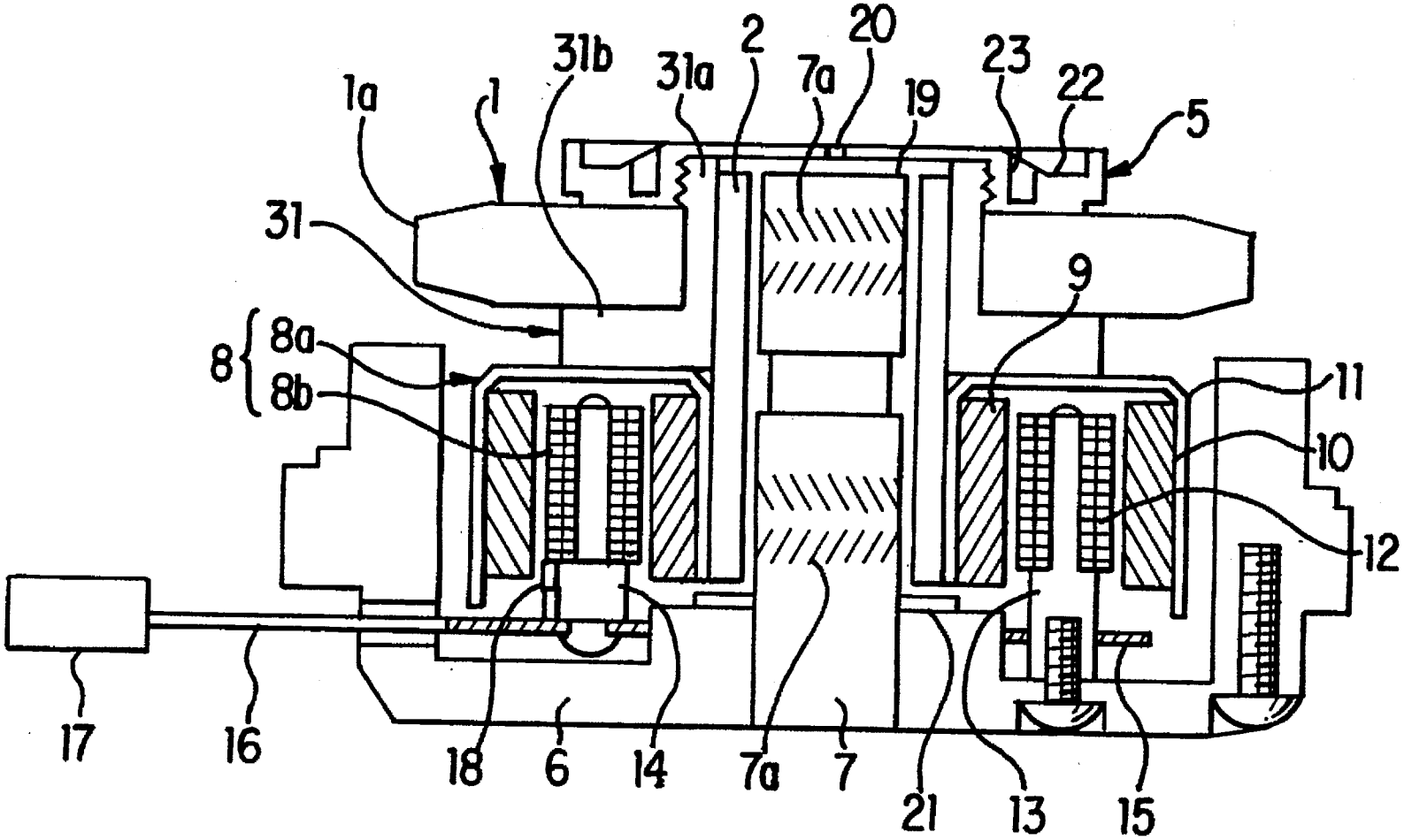
FIG. 7 is a similar view but showing a third preferred embodiment of the present invention.
Figure 8:
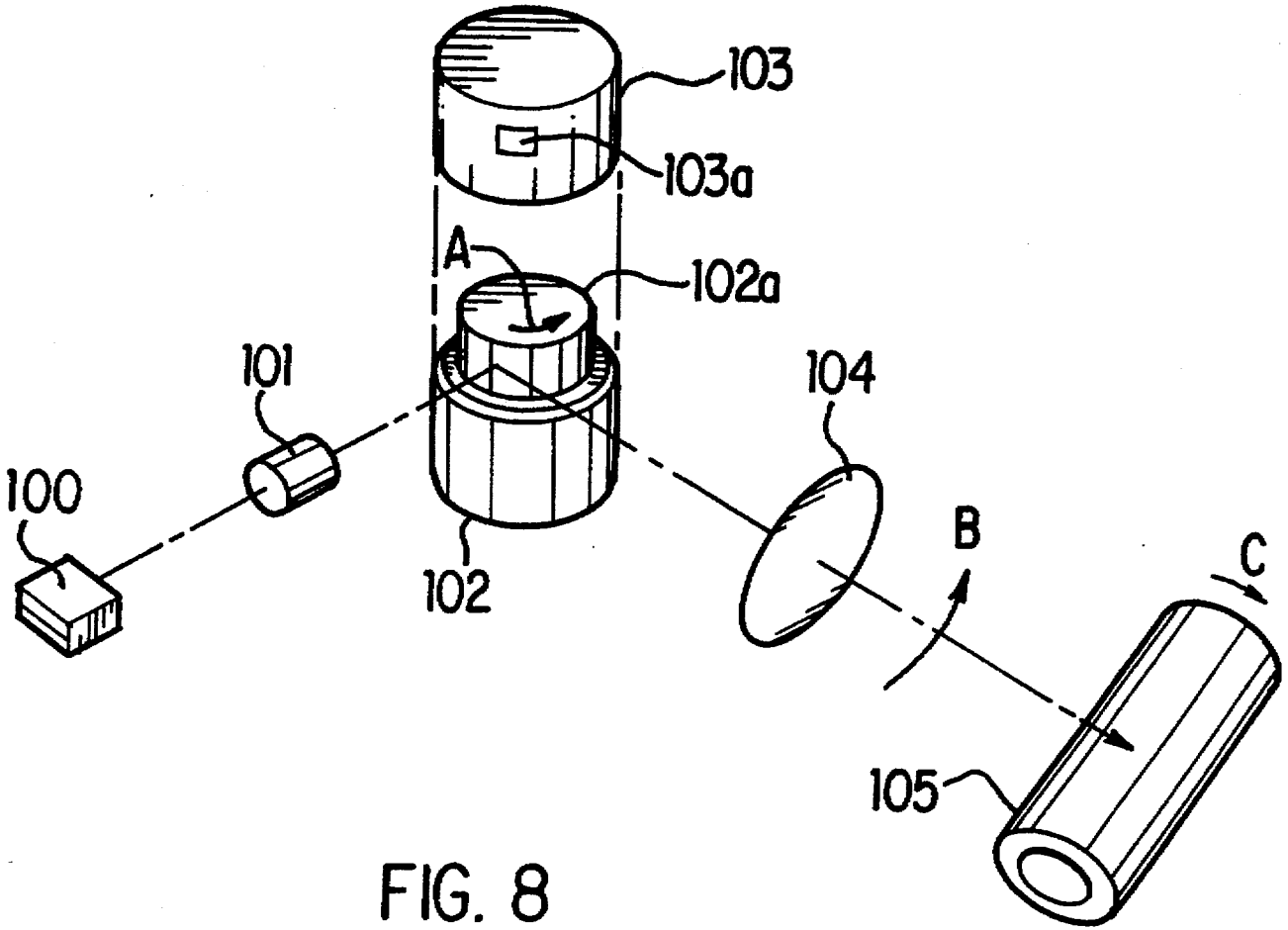
FIG. 8 is a schematic perspective view showing an exemplary arrangement employing a light deflector.

Referring now to FIG. 7, there is shown a light deflector according to a third preferred embodiment of the present invention. Also the present light deflector is a modification to and different from the light deflector of the first embodiment in that a polygon mirror securing sleeve 31 on which a male thread portion 31*a* with which the mirror cap is screwed and a mirror flange 31*b* are formed integrally is force fitted in the rotary sleeve 2 and the polygon mirror 1 is secured to the polygon mirror securing sleeve 31.

The polygon mirror securing sleeve 31 has a Young's modulus and a coefficient of thermal expansion substantially equal to those of the polygon mirror 1 so that the mirror cap 5 and the mirror flange 31*b* may not compress the polygon mirror 1 excessively by an influence of a centrifugal force and heat. Consequently, otherwise possible distortion of the reflection mirror faces la can be prevented effectively.

Figure 9:
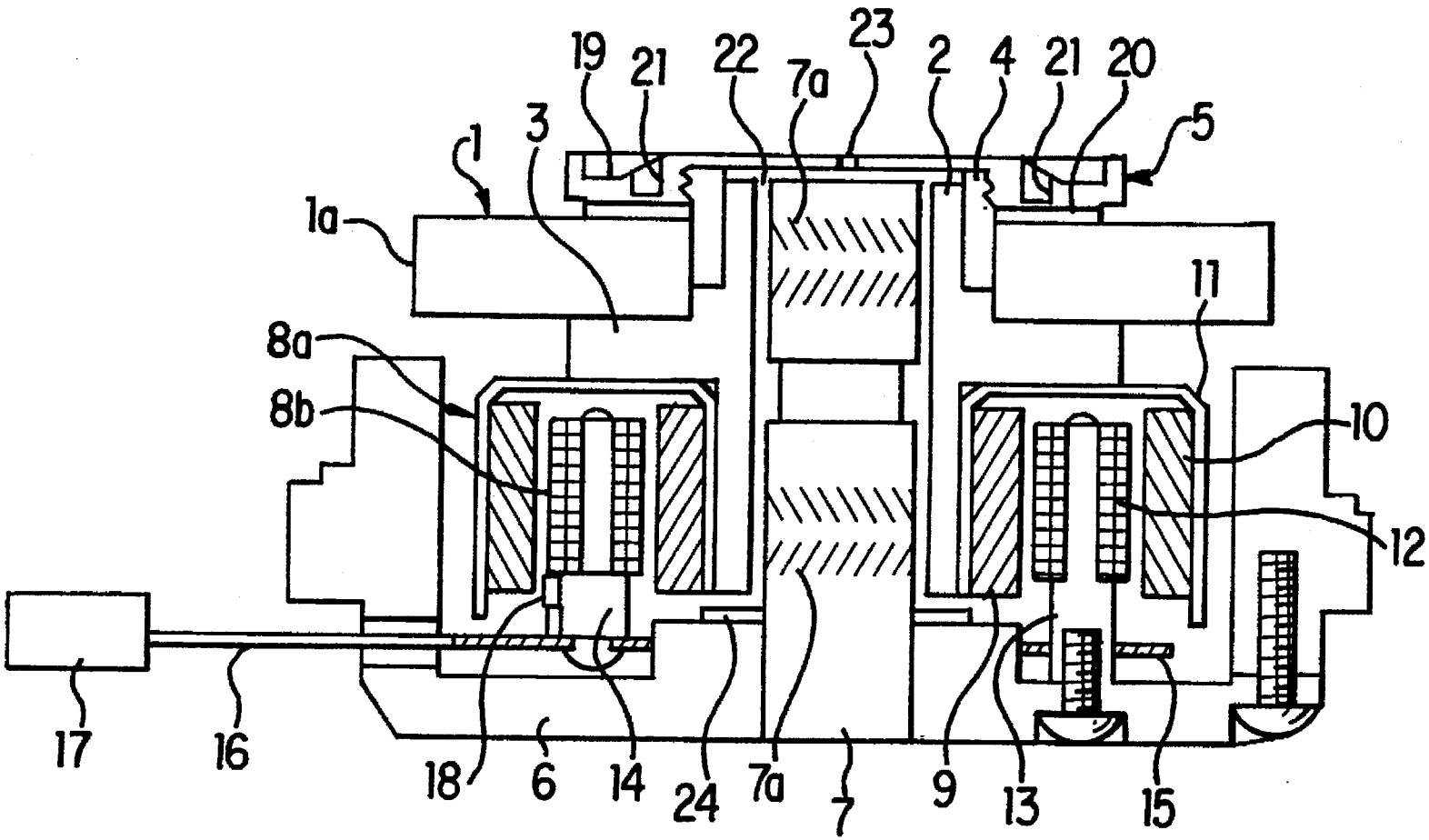
FIG. 9 is a schematic axial sectional view of a still further light deflector showing a fourth preferred embodiment of the present invention.

Referring now to FIG. 9, there is shown a light deflector according to a fourth preferred embodiment of the present invention. Also the present light deflector is a modification to the light deflector of the first embodiment. The present light deflector is different from the light deflector of the first embodiment in that a disk-shaped pressure adjustment member 27 is held between the polygon mirror 1 and the mirror cap 5. The pressure adjustment member 27 has a thickness of 0.1 mm and is formed from polyethylene terephthalate. The pressure adjustment member 27 has a center opening hole formed therein for fitting with the rotary sleeve 2 and the screw member 4. The polygon mirror 1 is formed from aluminum, and therefore, the pressure adjustment member 27 has a Young's modulus equal to or lower than that of the polygon mirror 1. Accordingly, when it is tried to tighten the mirror cap 5 to secure the polygon mirror 1, even if the pressing force acts locally upon the polygon mirror 1, the pressure adjustment member 27 disperses and absorbs the local pressing force, and consequently, local non-uniform concentrated stress is not generated in the polygon mirror 1 and otherwise possible distortion of the reflection mirror faces 1*a* of the polygon mirror 1 can be suppressed.

The pressure adjustment member 27 may be formed from, in place of polyethylene terephthalate mentioned hereinabove, a polyphenyl ether resin, polyphenyl sulfide or polybutylene terephthalate. Further, if the pressure adjustment member 27 in this instance is formed from a material having a coefficient of linear expansion substantially equal to that of the polygon mirror 1, then the elongation of the pressure adjustment member 27 in a radial direction caused by a rise of temperature is substantially equal to that of the polygon mirror 1, and accordingly, local compressive stress or tensile stress is not generated in the polygon mirror 1. Also in this regard, distortion of the reflection mirror faces 1*a* of the polygon mirror 1 can be suppressed.

Figure 10:
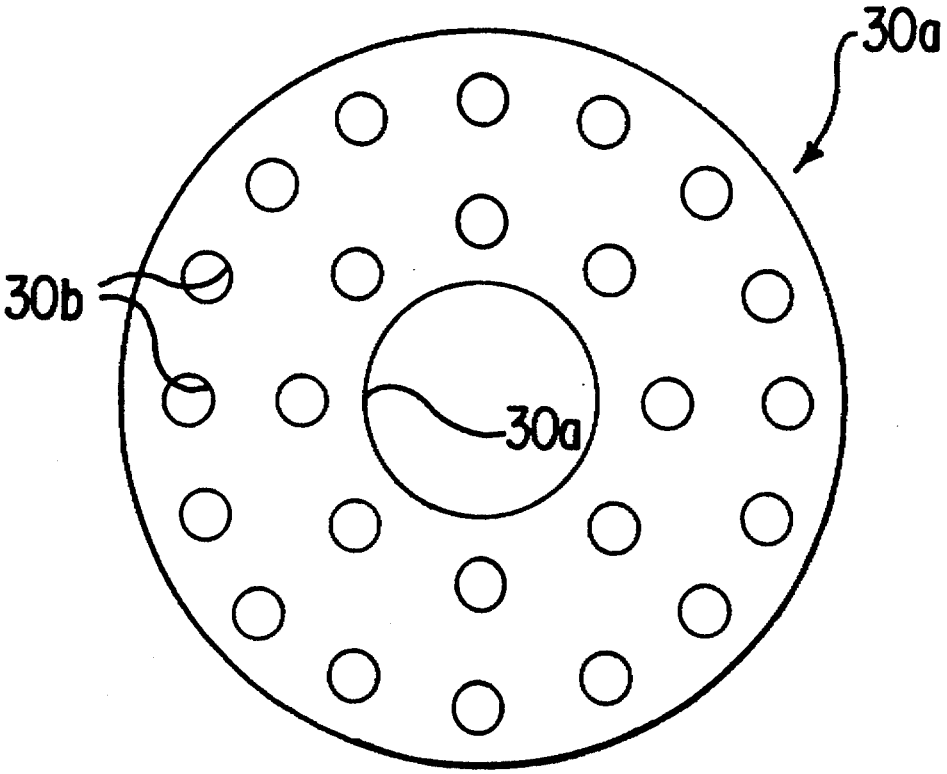
FIG. 10 is a plan view of a pressure adjustment member employed in the light deflector shown in FIG. 9.

Another pressure adjustment member is shown in FIG. 10. Referring to FIG. 10, the pressure adjustment member 40 shown has a plurality of holes 40*b* formed therein in addition to a center opening hole 40*a* so that it may efficiently disperse and moderate the pressing force of the mirror cap 5 acting on the polygon mirror 1. Accordingly, where the present pressure adjustment member 40 is employed, distortion of the reflection mirror faces 1*a* of the polygon mirror 1 can be suppressed further effectively.

Figure 11:
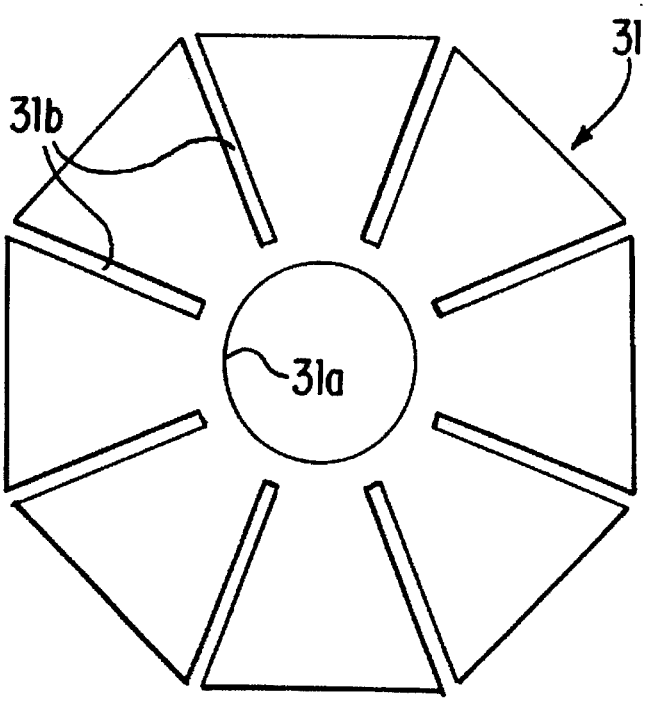
FIGS. 11 and 12 are similar views but showing pressure adjustment members of different forms.

Meanwhile, a further pressure adjustment member 41 shown in FIG. 11 has a plurality of radial slits 41*b* formed therein in addition to a center opening hole 41*a*. The slits 41*b* correspond to outer angles of the polygon mirror 1. Also with the present arrangement, since the slits 41*b* are formed in the pressure adjustment member 41, the pressing force of the mirror cap 5 can be dispersed and moderated in conformity with the profile of the polygon mirror 1.

Figure 12:
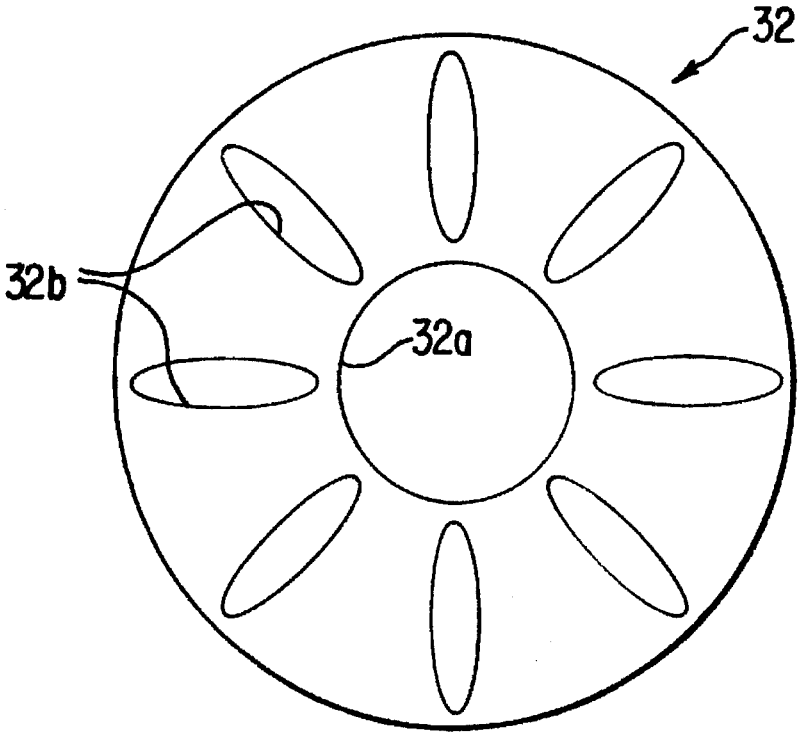

A still further pressure adjustment member 42 shown in FIG. 12 has a plurality of elliptic slits 42*b* formed radially therein in addition to a center opening hole 42*a*. Also the present pressure adjustment member 42 may be formed in a polygonal shape having a number of outer angles equal to that of the polygon mirror 1.

Figure 13:
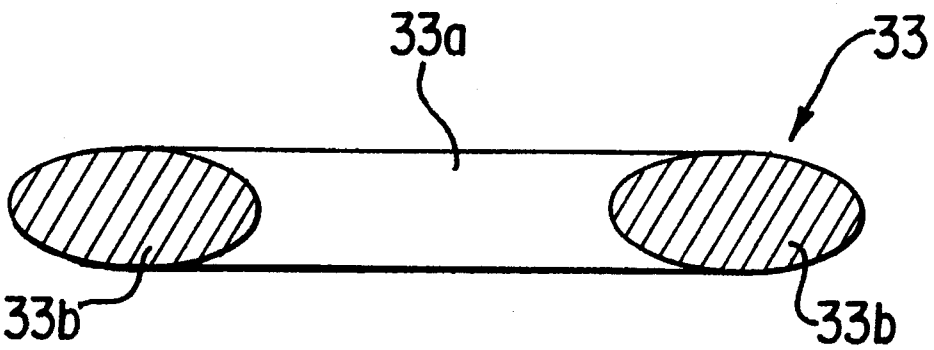
FIG. 13 is a cross sectional view showing a further different pressure adjustment member.

A yet further pressure adjustment member 43 shown in FIG. 13 is formed from a hollow material such as a tube shaped into an annular profile. The rotary sleeve 2 and the screw member 4 are fitted in a center opening hole 43*a* of the annular pressure adjustment member 43. A hollow portion 43*b* of the pressure adjustment member 43 is filled with air and is resiliently crushed in accordance with the pressing force of the mirror cap 5. Consequently, the pressure adjustment member 43 can efficiently disperse and moderate the pressing force to act upon the mirror cap 5, and distortion of the reflection mirror faces 1*a* of the polygon mirror 1 can be suppressed.

Having now fully described the invention, it will be apparent to one of ordinary skill in the art that many changes and modifications can be made thereto without departing from the spirit and scope of the invention as set forth herein.

What is claimed is:

1. A light deflector, comprising:

a polygon mirror having a plurality of reflection mirror faces formed on an outer periphery thereof;

a rotary member rotatable at a predetermined speed and including an annular flange to which said polygon mirror is secured;

a screw member having a thread formed thereon and fitted on an outer periphery of said rotary member, said screw member having a Young's modulus lower than that of said rotary member; and a mirror cap screwed with said screw member to press said polygon mirror against said annular flange to secure said polygon mirror to said rotary member.

2. A light deflector according to claim 1, wherein at least one of a Young's modulus and a coefficient of thermal expansion of said screw member is substantially equal to that of said polygon mirror.

3. A light deflector according to claim 2, wherein at least one of a Young's modulus and a coefficient of thermal expansion of said screw member is substantially equal to that of said mirror cap.

4. A light deflector according to claim 3, wherein at least one of a Young's modulus and a coefficient of thermal expansion of said annular flange is substantially equal to those of said mirror cap and said screw member.

5. A light deflector according to claim 1, wherein a coefficient of thermal expansion of at least one of said annular flange and said mirror cap is substantially equal to that of said polygon mirror.

6. A light deflector according to claim 1, wherein a Young's modulus of at least one of said annular flange and said mirror cap is substantially equal to that of said polygon mirror.

7. A light deflector according to claim 1, wherein said mirror flange has an outer profile substantially same as or similar to that of said polygon mirror.

8. A light deflector comprising:

a polygon mirror having a plurality of reflection mirror faces formed on an outer periphery thereof;

a rotary member rotatable at a predetermined speed and including an annular flange to which said polygon mirror is secured;

a screw member having a thread formed thereon and fitted on an outer periphery of said rotary member;

a mirror cap screwed with said screw member to press said polygon mirror against said annular flange to secure said polygon mirror to said rotary member; and a pressure adjustment member disposed between said polygon mirror and said mirror cap and having a Young's modulus substantially equal to or lower than that of said polygon mirror.

9. A light deflector according to claim 8, wherein said pressure adjustment member has a coefficient of thermal expansion substantially equal to that of said polygon mirror.

10. A light deflector according to claim 8, wherein said pressure adjustment member has a plurality of holes formed therein.

11. A light deflector according to claim 8, wherein said pressure adjustment member has a plurality of radial slits formed therein.

12. A light deflector according to claim 8, wherein said pressure adjustment member has a hollow structure.

13. A light deflector, comprising:

a polygon mirror having a plurality of reflection mirror faces formed on an outer periphery thereof;

a rotary member rotatable at a predetermined speed and including an annular flange to which said polygon mirror is secured;

a screw member having a thread formed thereon and fitted on an outer periphery of said rotary member;

means for reducing transmission of deforming forces from the screw member to the rotary member; and a mirror cap screwed with said screw member to press said polygon mirror against said annular flange to secure said polygon mirror to said rotary member, wherein said screw member has at least one of a Young's modulus and a coefficient of thermal expansion substantially equal to that of said mirror cap.

14. A light deflector, comprising:

a polygon mirror having a plurality of reflection mirror faces formed on an outer periphery thereof;

a rotary member rotatable at a predetermined speed and including an annular flange to which said polygon mirror is secured;

a screw member having a thread formed thereon and fitted on an outer periphery of said rotary member, said screw member having at least one of a Young's modulus and a coefficient of thermal expansion substantially equal to that of said polygon mirror; and a mirror cap screwed with said screw member to press said polygon mirror against said annular flange to secure said polygon mirror to said rotary member.

15. A light deflector according to claim 14, wherein at least one of a Young's modulus and a coefficient of thermal expansion of said screw member is substantially equal to that of said mirror cap.

16. A light deflector according to claim 15, wherein at least one of a Young's modulus and a coefficient of thermal expansion of said annular flange is substantially equal to those of said mirror cap and said screw member.

* * * * *